US008649957B2

(12) United States Patent
Yoshizaki et al.

(10) Patent No.: US 8,649,957 B2
(45) Date of Patent: Feb. 11, 2014

(54) CONTROL DEVICE FOR INTERNAL COMBUSTION ENGINE

(75) Inventors: Satoshi Yoshizaki, Sunto-gun (JP); Shuntaro Okazaki, Gotemba (JP); Masashi Shibayama, Sunto-gun (JP); Kaoru Shokatsu, Susono (JP); Hajime Kawakami, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/520,502

(22) PCT Filed: Jan. 24, 2011

(86) PCT No.: PCT/JP2011/051223

§ 371 (c)(1),
(2), (4) Date: Jul. 3, 2012

(87) PCT Pub. No.: WO2012/101739

PCT Pub. Date: Aug. 2, 2012

(65) Prior Publication Data

US 2013/0297186 A1 Nov. 7, 2013

(51) Int. Cl.

| | |
|---|---|
| ***F02D 9/02*** | (2006.01) |
| ***F02D 41/14*** | (2006.01) |
| ***F02D 41/30*** | (2006.01) |

(52) U.S. Cl.
USPC ..... 701/103

(58) Field of Classification Search
USPC ..... 701/103, 104; 60/299, 300, 301
See application file for complete search history.

(56) References Cited

U.S. PATENT DOCUMENTS

| | | | | |
|---|---|---|---|---|
| 5,579,637 | A | 12/1996 | Yamashita et al. | |
| 6,877,311 | B2 * | 4/2005 | Uchida | 60/276 |
| 7,121,082 | B2 * | 10/2006 | Nakagawa et al. | 60/301 |
| 7,779,619 | B2 * | 8/2010 | Takubo | 60/285 |
| 7,899,605 | B2 * | 3/2011 | Kojima | 701/103 |
| 2011/0005212 | A1 * | 1/2011 | Matsushita et al. | 60/299 |

FOREIGN PATENT DOCUMENTS

| | | |
|---|---|---|
| JP | A-6-213039 | 8/1994 |
| JP | A-8-49585 | 2/1996 |
| JP | A-2003-328809 | 11/2003 |
| JP | A-2009-36107 | 2/2009 |
| JP | A-2009-299667 | 12/2009 |
| JP | A-2010-7489 | 1/2010 |

OTHER PUBLICATIONS

International Search Report issued in International Application No. PCT/JP2011/051223 on Feb. 22, 2011 (with translation).

* cited by examiner

*Primary Examiner* — Stephen K Cronin
*Assistant Examiner* — Arnold Castro
(74) *Attorney, Agent, or Firm* — Oliff PLC

(57) ABSTRACT

A control device is provided that generates a target air-fuel ratio by lessening a change speed of a required air-fuel ratio of an internal combustion engine. However, when a deterioration degree of a catalyst which is disposed in an exhaust passage of the internal combustion engine is a predetermined reference or more, lessening of the change speed of the required air-fuel ratio is stopped, or a lessening degree of the change speed of the required air-fuel ratio is decreased. The control device calculates a target air quantity for realizing the required torque under the target air-fuel ratio. For calculation of the target air quantity, data in which relationship of torque generated by the internal combustion engine and an air quantity taken into a cylinder is fixed by being related to an air-fuel ratio can be used.

2 Claims, 3 Drawing Sheets

CONTROL DEVICE FOR INTERNAL COMBUSTION ENGINE

TECHNICAL FIELD

The present invention relates to a control device for an internal combustion engine, and particularly relates to a control device for an internal combustion engine which adopts torque and an air-fuel ratio as control variables.

BACKGROUND ART

As one of the control methods of internal combustion engines, there is known torque demand control which determines a manipulated variable of each actuator with toque as a control variable. Japanese Patent Laid-Open No. 2009-299667 describes one example of the control device which performs torque demand control. The control device described in Japanese Patent Laid-Open No. 2009-299667 (hereinafter, a conventional control device) is a control device which performs torque control by control of an air quantity by a throttle, control of an ignition timing by an ignition device, and control of a fuel injection quantity by a fuel supply system.

Incidentally, in addition to the quantity of the air which is taken into a cylinder, an air-fuel ratio is closely related to the torque which is generated by an internal combustion engine. Accordingly, in the conventional control device, the air-fuel ratio which is obtained from the present operation state information is referred to in the process of converting the required torque into a target value of the air quantity. The air-fuel ratio in this case does not mean the air-fuel ratio of the exhaust gas which is measured by an air-fuel ratio sensor, but means the air-fuel ratio of the mixture gas in the cylinder, that is, a required air-fuel ratio.

The required air-fuel ratio is not always constant, and is sometimes positively changed to keep emission performance. In such a case, according to the conventional control device, the target air quantity changes in accordance with change in the required air-fuel ratio, and a throttle opening is also controlled in correspondence with the target air quantity. The movement of the throttle at this time becomes such movement as to cancel out the torque variation accompanying the change of the air-fuel ratio by increase and decrease of the air quantity. That is to say, when the air-fuel ratio changes to a rich side, the throttle moves to the closing side so as to cancel out the increase in torque due to this by decrease in the air quantity. Conversely, when the air-fuel ratio changes to a lean side, the throttle moves to an opening side so as to cancel out the decrease in torque by increase in the air quantity.

However, there is a delay in the response of the air quantity to the movement of the throttle, and the actual air quantity changes late with respect to the change of the target air quantity. The delay becomes more noticeable as the change speed of the target air quantity is higher. Accordingly, in the conventional control device, change of the air quantity is unlikely to catch up with abrupt change of the air-fuel ratio when abrupt change takes place in the required air-fuel ratio. In this case, a deviation occurs between the torque generated by the internal combustion engine and the required torque, and not only torque control with high precision cannot be realized, but also worsening of emission performance can be caused due to unintended variation of the air-fuel ratio as a result.

As is known from the above, the conventional control device can be said to have a room for further improvement in the respect of the precision of realization of the required torque in the situation where the required air-fuel ratio can change.

CITATION LIST

Patent Literature

Patent Literature 1: Japanese Patent Laid-Open No. 2009-299667

SUMMARY OF INVENTION

As the solution to the aforementioned problem, it is conceivable to use the required air-fuel ratio with the change speed being lessened in calculation of the target air quantity. As the means which lessens the change speed of the required air-fuel ratio, a low-pass filter such as a first-order lag filter, moderating processing such as weighted average, or guard processing for a change rate can be cited. By lessening the change speed of the required air-fuel ratio, delay of change of the air quantity with respect to change of the air-fuel ratio can be eliminated. Alternatively, even though delay of the change of the air quantity with respect to change of the air-fuel ratio cannot be completely eliminated, the delay can be sufficiently reduced to the extent that torque variation does not occur.

Incidentally, in the exhaust passage of an internal combustion engine, a catalyst (three way catalyst) for purifying exhaust gas is provided. When the air-fuel ratio of the exhaust gas which flows into the catalyst is rich, HC and CO are oxidized and made harmless by oxygen which is stored in the catalyst. Meanwhile, when the air-fuel ratio of the exhaust gas which flows in is lean, NOx is reduced and made harmless by noble metals contained in the catalyst, and oxygen which is obtained by reduction of NOx is stored inside the catalyst. The stored oxygen is used for oxidizing HC and CO when the air-fuel ratio of exhaust gas becomes rich again. More specifically, the catalyst effectively purifies the exhaust gas by the function of storing oxygen inside the catalyst. Accordingly, in order that the catalyst can exhibit the purifying ability, the storage amount of oxygen should not be depleted or saturated.

What influences the oxygen storage amount of a catalyst is the air-fuel ratio of the exhaust gas which flows into the catalyst. The aforementioned required air-fuel ratio is set so that the oxygen storage amount of the catalyst is kept appropriate. Accordingly, when the change speed of the required air-fuel ratio is lessened, a deviation occurs between the air-fuel ratio of the exhaust gas which flows into the catalyst and the original required air-fuel ratio, that is, the air-fuel ratio for keeping the oxygen storage amount of the catalyst appropriate, and the oxygen storage amount of the catalyst changes in a depleted direction or in a saturated direction. The deviation of the air-fuel ratio which is allowed at this time is determined by the deterioration state of the catalyst. The catalyst is deteriorated by poisoning by sulfur components contained in a fuel, or heat applied to the catalyst as the catalyst is continuously used, and the oxygen storage ability is decreasing in accordance with the degree of the deterioration. Accordingly, with the catalyst which is not in an advanced state of deterioration, the oxygen storage ability thereof is kept high, and therefore, even if the change speed of the required air-fuel ratio is lessened, the oxygen storage amount is not immediately depleted or saturated thereby. However, in the case of the catalyst in an advanced state of deterioration, the oxygen storage ability thereof becomes low, and therefore, by lessening the change speed of the required air-fuel ratio, the oxygen storage amount can be depleted or saturated. Accordingly, it is not always preferable to lessen the change speed of the required air-fuel ratio indiscriminately without exception from the viewpoint of the emission performance.

An object of the present invention is to enhance precision of realization of a required torque while changing an air-fuel ratio to keep emission performance. In order to attain such an object, the present invention provides a control device for an internal combustion engine as follows.

The control device provided by the present invention acquires the required torque of an internal combustion engine and a required air-fuel ratio and generates a target air-fuel ratio by lessening the change speed of the acquired air-fuel ratio. However, as a result that information relating to a deterioration degree of a catalyst is obtained, and determination is performed based on the acquired information, if the deterioration degree of the catalyst is a predetermined reference or more, lessening of the change speed of the required air-fuel ratio is stopped, or a lessening degree of the change speed of the required air-fuel ratio is decreased. The present control device calculates a target air quantity for realizing the required torque under the target air-fuel ratio. For calculation of the target air quantity, data in which a relationship of torque generated by the internal combustion engine and an air quantity taken into a cylinder is fixed by being related to an air-fuel ratio can be used. The present control device manipulates an actuator for air quantity control in accordance with the target air quantity, and manipulates an actuator for fuel injection quantity control in accordance with the target air-fuel ratio.

According to the control device which is configured as above, the required air-fuel ratio with the change speed thereof being lessened is used for calculation of the target air quantity, and therefore, a response delay of the actual air quantity with respect to the target air quantity can be eliminated or sufficiently reduced. As a result, according to the present control device, a delay of change of the air quantity with respect to change of the air-fuel ratio can be eliminated or sufficiently reduced, and realization precision of high torque can be kept.

Meanwhile, when the deterioration degree of the catalyst is the predetermined reference or more, lessening of the change speed of the required air-fuel ratio is stopped, or the lessening degree of the change speed of the required air-fuel ratio is decreased, and therefore, the deviation between the air-fuel ratio of the exhaust gas which flows into the catalyst and the original required air-fuel ratio can be decreased. Thereby, even with the catalyst the oxygen storage ability of which is decreased, the oxygen storage amount thereof can be kept appropriate, and the emission performance is kept in a high state. In this case, a deviation is likely to occur between the torque generated by the internal combustion engine and the required torque, but the deviation can be eliminated by regulating the ignition timing. For example, when the torque generated by the internal combustion engine is expected to be higher than the required torque from the relationship of the change speed of the required air-fuel ratio and the change speed of the air quantity, the variation of the torque with change in the required air-fuel ratio can be suppressed by retarding the ignition timing.

DESCRIPTION OF EMBODIMENTS

An embodiment of the present invention will be described with reference to the drawings.

An internal combustion engine (hereinafter, an engine) which is an object to be controlled in the embodiment of the present invention is a spark ignition type four-cycle reciprocal engine. In an exhaust passage of the engine, a catalyst (three way catalyst) having an oxygen storing function is provided. An air-fuel ratio sensor is disposed upstream of the catalyst in the exhaust passage, and an $O_2$ sensor is disposed downstream of the catalyst. Further, an air flow meter is disposed in the exhaust passage of the engine. A control device controls an operation of the engine by manipulating actuators included in the engine. The actuators which can be manipulated by the control device include an ignition device, a throttle, a fuel injection device, a variable valve timing mechanism, an EGR device and the like. However, in the present embodiment, the control device manipulates a throttle, an ignition device and a fuel injection device, and the control device manipulates the three actuators to control the operation of the engine.

The control device of the present embodiment uses torque, an air-fuel ratio and an efficiency as control variables of the engine. To be exact, the torque mentioned here means indicated torque, and the air-fuel ratio means the air-fuel ratio of a mixture gas which is provided for combustion. The efficiency in the present specification means the ratio of the torque which is actually outputted to potential torque which the engine can output. The maximum value of the efficiency is 1, and at this time, the potential torque which the engine can output is directly outputted actually. When the efficiency is smaller than 1, the torque which is actually outputted is smaller than the potential torque which the engine can output, and the margin thereof mainly becomes heat and is outputted from the engine.

Figure 1:
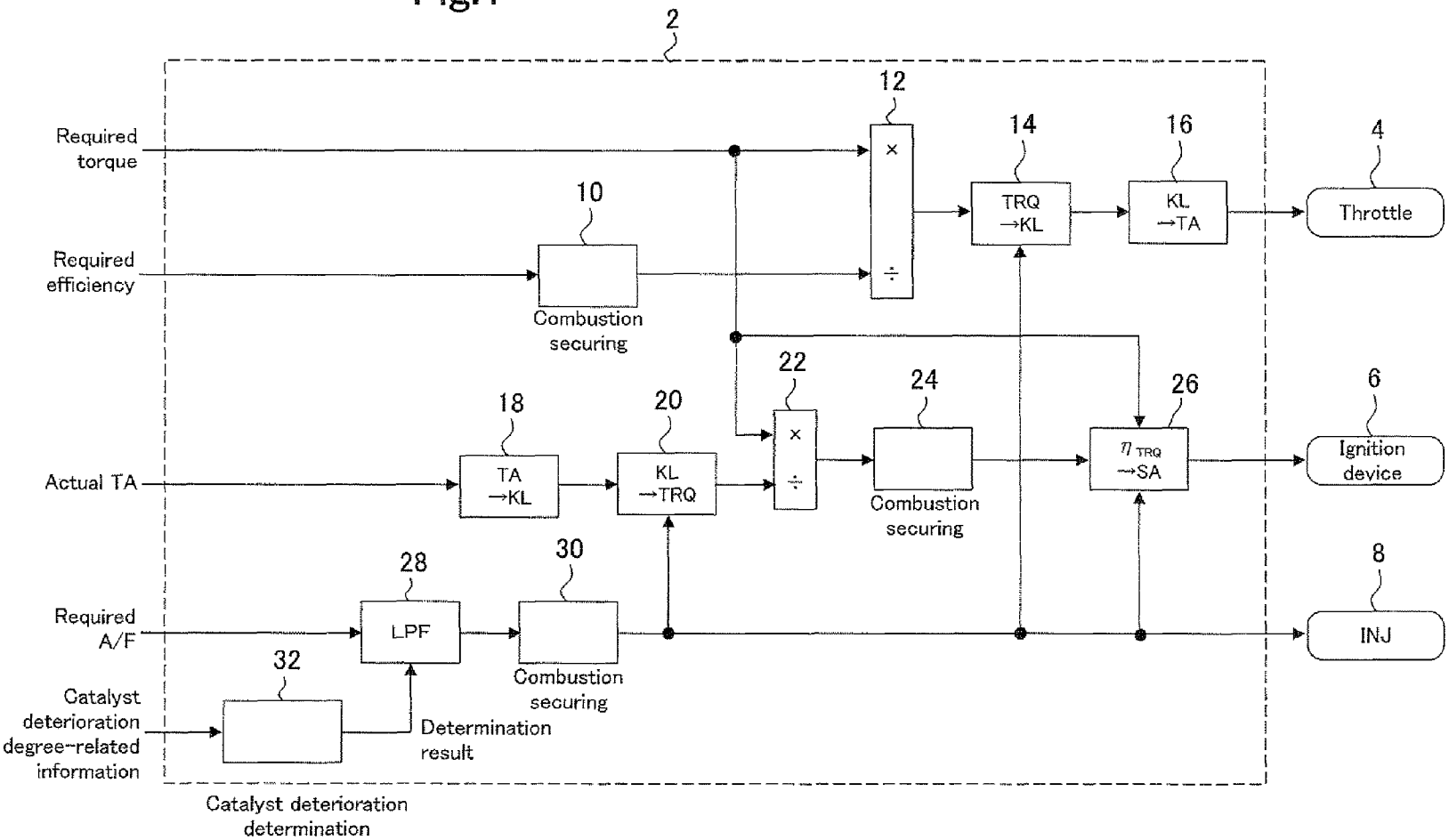
FIG. 1 is a block diagram showing a configuration of a control device of an embodiment of the present invention.

A control device 2 shown in a block diagram of FIG. 1 shows a configuration of the control device of the present embodiment. The control device 2 can be divided into a combustion securing guard section 10, an air quantity control torque calculating section 12, a target air quantity calculating section 14, a throttle opening calculating section 16, an estimated air quantity calculating section 18, an estimated torque calculating section 20, an ignition timing control efficiency calculating section 22, a combustion securing guard section 24, an ignition timing calculating section 26, a target air-fuel ratio generating section 28, a combustion securing guard section 30, and a catalyst deterioration determining section 32 according to the functions which these sections have. These elements 10 to 32 are result of especially expressing, in the diagram, only the elements relating to torque control and air-fuel ratio control by operation of the three actuators, that is, the throttle 4, the ignition device 6 and the fuel injection device (INJ) 8, out of various functional elements which the control device 2 has. Accordingly, FIG. 1 does not mean that the control device 2 is configured by only these elements. Each of the elements may be configured by exclusive hardware, or may be virtually configured by software with the hardware shared by each of the elements. Hereinafter, the configuration of the control device 2 will be described with particular emphasis on the functions of the elements 10 to 32.

First, a required torque, a required efficiency and a required air-fuel ratio (required A/F) are inputted in the present control device as requirements to the control variables of the engine. These requirements are supplied from a power train manager which is located at a higher order than the present control device. The required torque is set in accordance with the operation conditions and the operation state of the engine, more specifically, based on the manipulated variable of an accelerator pedal by a driver, and signals from the control systems of the vehicle such as VSC and TRC. The required efficiency is set at a value smaller than 1 when the temperature of the exhaust gas is desired to be raised, and when a reserve torque is desired to be made. However, in the present embodiment, the required efficiency is assumed to be set at 1 which is the maximum value. The required air-fuel ratio is changed so that the oxygen storage amount of the catalyst is kept appropriate with stoichiometry as a center. More specifically, the required air-fuel ratio is positively changed by open loop control, and the required air-fuel ratio is changed by air-fuel ratio feedback control.

The required torque and the required efficiency received by the control device 2 are inputted in the air quantity control torque calculating section 12. The air quantity control torque calculating section 12 calculates air quantity control torque by dividing the required torque by the required efficiency. When the required efficiency is smaller than 1, the air quantity control toque is increased more than the required torque. This means that the throttle is required to be able to output torque larger than the required torque potentially. However, with regard to the required efficiency, what passes through the combustion securing guard section 10 is inputted in the air quantity control torque calculating section 12. The combustion securing guard section 10 restricts the minimum value of the required efficiency which is used for calculation of the air quantity control torque by the guard value for securing proper combustion. In the present embodiment, the required efficiency is 1, and therefore, the required torque is directly calculated as the air quantity control torque.

The air quantity control torque is inputted in the target air quantity calculating section 14. The target air quantity calculating section 14 converts air quantity control torque (TRQ) into a target air quantity (KL) by using an air quantity map. The air quantity mentioned here means an air quantity which is taken into the cylinder (charging efficiency which is the result of rendering the air quantity dimensionless or a load factor can be used instead). The air quantity map is a map in which torque and an air quantity are related to each other with various engine state quantities including an engine speed and an air-fuel ratio as a key, assuming that the ignition timing is the optimum ignition timing (of the MBT and the trace knock ignition timing, whichever is more retarded) as a prerequisite. For search of the air quantity map, the actual values and the target values of the engine state quantities are used. With regard to the air-fuel ratio, the target air-fuel ratio which will be described later is used for map search. Accordingly, in the target air quantity calculating section 14, the air quantity required for realization of the air quantity control torque under the target air-fuel ratio which will be described later is calculated as the target air quantity of the engine.

The target air quantity is inputted in the throttle opening calculating section 16. The throttle opening calculating section 16 converts the target air quantity (KL) into a throttle opening (TA) by using an inverse model of an air model. The air model is a physical model which is made by modeling the response property of the air quantity to the motion of the throttle 4, and therefore, by using the inverse model of the air model, the throttle opening which is required for achievement of the target air quantity can be inversely calculated.

The control device 2 performs manipulation of the throttle 4 in accordance with the throttle opening which is calculated in the throttle opening calculating section 16. When delay control is carried out, a deviation corresponding to a delay time occurs between the throttle opening (target throttle opening) which is calculated in the throttle opening calculating section 16 and the actual throttle opening which is realized by movement of the throttle 4.

The control device 2 carries out calculation of an estimated air quantity based on the actual throttle opening in the estimated air quantity calculating section 18, in parallel with the above described processing. The estimated air quantity calculating section 18 converts the throttle opening (TA) into the air quantity (KL) by using a forward model of the aforementioned air model. The estimated air quantity is an air quantity which is estimated to be realized by manipulation of the throttle 4 by the control device 2.

The estimated air quantity is used for calculation of the estimated torque by the estimated torque calculating section 20. The estimated torque in the present description is an estimated value of the torque which can be outputted when the ignition timing is set at an optimal ignition timing under the present throttle opening, that is, the torque which can be potentially outputted by the engine. The estimated torque calculating section 20 converts the estimated air quantity into the estimated torque by using a toque map. The torque map is an inverse map of the aforementioned air quantity map, and is a map in which the air quantity and torque are related with various engine state quantities as the key on the precondition that the ignition timing is an optimal ignition timing. In search of the torque map, the target air-fuel ratio which will be described later is used for search of the map. Accordingly, in the estimated torque calculating section 20, the torque which is estimated to be realized by the estimated air quantity under the target air-fuel ratio which will be described later is calculated.

The estimated torque is inputted in the ignition timing control efficiency calculating section 22 together with the duplicated target torque. The ignition timing control efficiency calculating section 22 calculates the ratio of the target torque to the estimated torque as an ignition timing control efficiency. However, the maximum value of the ignition timing control efficiency is restricted to 1. The calculated ignition timing control efficiency is inputted in the ignition timing calculating section 26 after passing through the combustion securing guard section 24. The combustion securing guard section 24 restricts the minimum value of the ignition timing control efficiency by the guard value which secures combustion.

The ignition timing calculating section 26 calculates an ignition timing (SA) from the inputted ignition timing control efficiency ($\eta_{TRQ}$). In more detail, the optimal ignition timing is calculated based on the engine state quantities such as the engine speed, the required torque and the target air-fuel ratio, and calculates a retard amount with respect to the optimal ignition timing from the ignition timing control efficiency which is inputted. Subsequently, what is obtained by adding the retard amount to the optimal ignition timing is calculated as a final ignition timing. For calculation of the optimal ignition timing, a map in which the optimal ignition timing and the various engine state quantities are related with one another can be used, for example. For calculation of the retard amount, a map in which the retard amount and the ignition timing control efficiency, and various engine state quantities are related with one another can be used, for example. When the ignition timing control efficiency is 1, the retard amount is set as zero, and as the ignition timing control efficiency is smaller than 1, the retard amount is made larger.

The control device 2 performs manipulation of the ignition device 6 in accordance with the ignition timing calculated in the ignition timing calculating section 26.

Further, the control device 2 carries out processing for generating the target air-fuel ratio of the engine from the required air-fuel ratio in the target air-fuel ratio generating section 28 in parallel with the above described processing. The target air-fuel ratio generating section 28 includes a low-pass filter (for example, a first-order lag filter). The target air-fuel ratio generating section 28 passes the signal of the required air-fuel ratio which is inputted in the control device 2 through the low-pass filter, and outputs the signal which passes through the low-pass filter as the target air-fuel ratio. More specifically, the target air-fuel ratio generating section 28 generates the target air-fuel ratio by lessening the change speed of the required air-fuel ratio by the low-pass filter. However, depending on the determination result by the catalyst deterioration determining section 32 which will be described later, lessening of the change speed of the required air-fuel ratio is not performed. In such a case, the target air-fuel ratio generating section 28 directly outputs the required air-fuel ratio which is not passed through the low-pass filter as the target air-fuel ratio.

The catalyst deterioration determining section 32 has the function of acquiring information relating to the deterioration degree of the catalyst, and determining the deterioration degree of the catalyst based on the acquired information. The concrete method for determining the deterioration degree of the catalyst is not limited. For example, a known method such as a Cmax method and a locus method can be used. In a Cmax method, the air-fuel ratio is forcefully oscillated to be rich/lean to adsorb/desorb oxygen in the catalyst forcefully. Subsequently, the change in the air-fuel ratio of the exhaust gas which flows from the catalyst at this time is sensed by an $O_2$ sensor, and the oxygen storage capacity (OSC) of the catalyst is calculated based on the output signal of the $O_2$ sensor. The OSC is a parameter which shows the deterioration degree of the catalyst, and as the OSC is larger, the deterioration degree of the catalyst can be determined as lower, whereas as the OSC is smaller, the deterioration degree of the catalyst can be determined as higher. In the locus method, the ratio of the locus length of the output signal of the air-fuel ratio sensor and the locus length of the output signal of the $O_2$ sensor, or the area ratio of the waveforms of the output signals of the two sensors are calculated as the parameter which shows the deterioration degree of the catalyst. As the other examples of the parameter which shows the deterioration degree of the catalyst, the integrated value of the traveling distance of a vehicle, which is obtained from the output signal of a traveling distance sensor, and the integrated value of the intake air quantity which is obtained from the output signal of an air flow meter can be cited.

Figure 2:
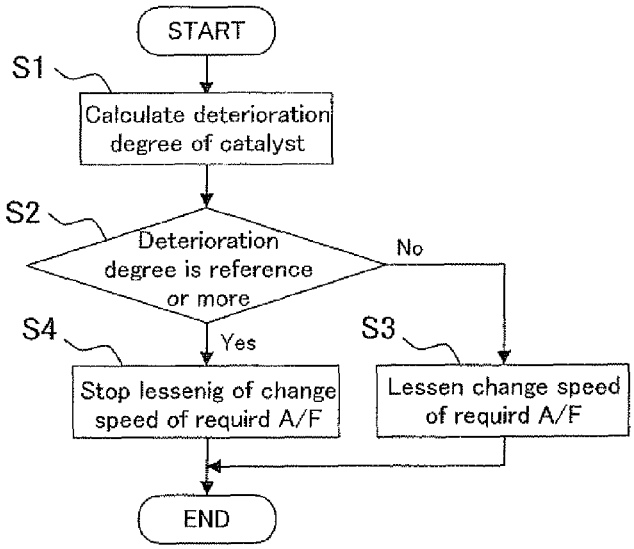
FIG. 2 is a flowchart showing processing carried out in the control device of the embodiment of the present invention.

FIG. 2 is a diagram expressing the processing which is performed in the target air-fuel ratio generating section 28 and the catalyst deterioration determining section 32 in a flowchart. The processing of each of steps S1 and S2 in the flowchart is the processing which is performed by the catalyst deterioration determining section 32. In the first step S1, the value of the parameter showing the deterioration degree of the catalyst is calculated. Subsequently, in the next step S2, it is determined whether the deterioration degree of the catalyst is a predetermined reference or more, based on the value of the aforesaid parameter. For example, when the parameter is the OSC of a Cmax method, the deterioration degree of the catalyst is determined as the reference or more if the OSC is a predetermined reference value or less. Meanwhile, if the OSC is larger than the reference value, the deterioration degree of the catalyst is determined as not exceeding the reference. The determination reference of the deterioration degree is the matter which is determined in accordance with the specifications of the engine, and is determined by adaptation in the design stage.

The processing of each of steps S3 and S4 is the processing which is performed by the target air-fuel ratio generating section 28. The processing of step S3 is selected when the determination result of step S2 is negative. In step S3, the required air-fuel ratio with the change speed lessened by the low-pass filter is outputted as the target air-fuel ratio. Meanwhile, the processing of step S4 is selected when the determination result of step S2 is affirmative. In step S4, lessening of the change speed of the required air-fuel ratio is stopped, and the required air-fuel ratio is directly outputted as the target air-fuel ratio.

The target air-fuel ratio which is generated in the target air-fuel ratio generating section 28 passes through the combustion securing guard section 30, and thereafter, is supplied to the target air quantity calculating section 14, the estimated torque calculating section 20, the ignition timing calculating section 26, and the fuel injection device 8. The combustion securing guard section 30 restricts the maximum value and the minimum value of the target air-fuel ratio by the guard value for securing proper combustion.

The control device 2 performs manipulation of the fuel injection device 8 in accordance with the target air-fuel ratio. In more detail, the control device 2 calculates the fuel injection quantity from the target air-fuel ratio and the estimated air quantity, and manipulates the fuel injection device 8 so as to realize the fuel injection quantity.

Figure 3:
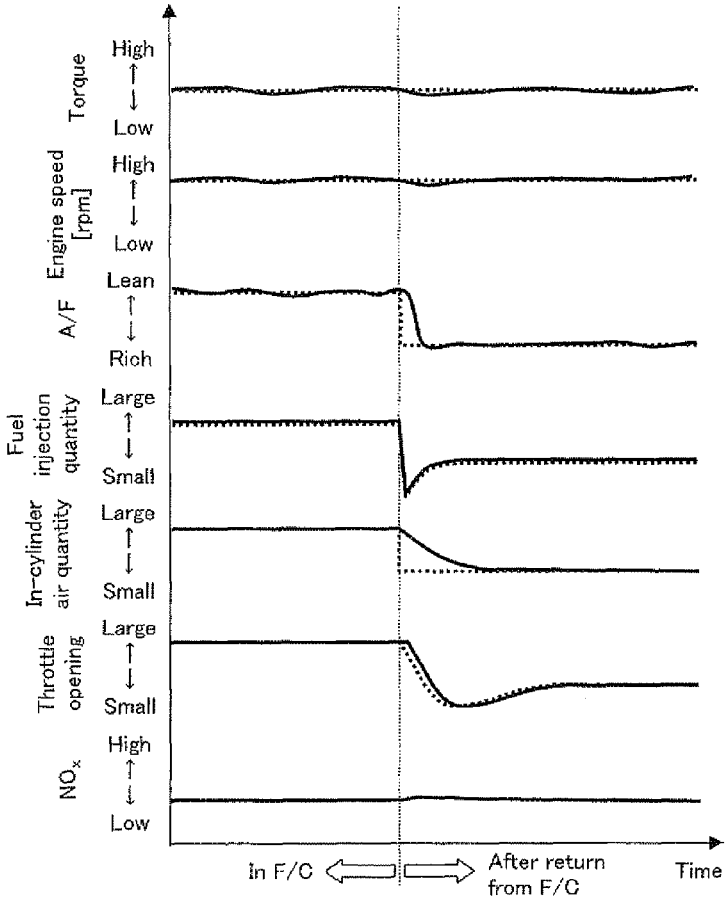
FIG. 3 is a diagram for explaining a content of engine control according to the embodiment of the present invention and a control result thereof.
Figure 4:
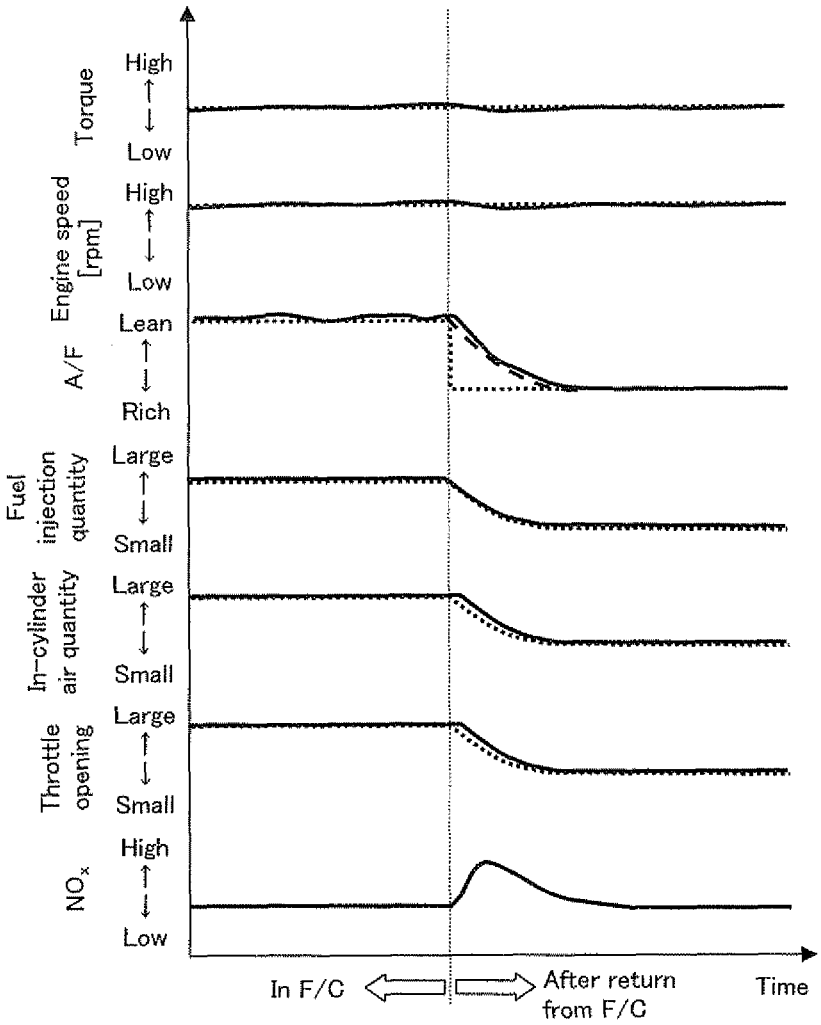
FIG. 4 is a diagram for explaining a content of engine control as a comparative example and a control result thereof.

FIG. 3 is a diagram showing a result of engine control which is realized by the control device 2 in the present embodiment. Meanwhile, FIG. 4 is a diagram showing a result of carrying out engine control as a comparative example. In the comparative example, processing of lessening the change speed of the required air-fuel ratio by the low-pass filter is always carried out. Hereinafter, the effect in engine control which is obtained in the present embodiment will be described by being compared with the comparative example.

Charts of the respective stages of each of FIGS. 3 and 4 show changes with time of the control variables and the state quantities when the required air-fuel ratio is changed to be rich from lean, in a situation in which deterioration of the catalyst advances. In the chart on each of the uppermost stages, a change with time of the required torque is shown by the dotted line, and a change with time of the torque which is actually generated by the engine is shown by the solid line. In the chart at each of the second stages, a change with time of the target engine speed is shown by the dotted line, and a change with time of the actual engine speed is shown by the solid line. In the chart at each of the third stages, a change with time of the required air-fuel ratio is shown by the dotted line, a change with time of the target air-fuel ratio is shown by the broken line, and a change with time of the actual air-fuel ratio is shown by the solid line. In the chart at each of the fourth stages, a change with time of the target fuel injection quantity which is calculated from the target air-fuel ratio is shown by the dotted line, and a change with time of the actual fuel injection quantity is shown by the solid line. In the chart at each of the fifth stages, a change with time of the target air quantity is shown by the dotted line, and a change with time of the actual air quantity taken into the cylinder is shown by the solid line. In the chart at each of the sixth stages, a change with time of the target throttle opening is shown by the dotted line, and a change with time of the actual throttle opening is shown by the solid line. In the chart at each of the lowermost stages, a change with time of the NOx concentration in the exhaust gas exhausted from the catalytic device is shown by the solid line.

As shown in the chart at the third stage of each of the drawings, the required air-fuel ratio takes on the semblance of a step signal and is changed to be rich from lean in some cases. In such a case, in the comparative example shown in FIG. 4, the step signal is processed by the low-pass filter, and thereby, the signal of the target air-fuel ratio which gradually changes to the rich side is generated. The target air-fuel ratio which gradually changes is used for calculation of the target air quantity, whereby the change of the target air quantity becomes gradual as shown in the chart at the fifth stage of FIG. 4, and the response delay of the actual air quantity with respect to the target air quantity is sufficiently reduced. As a result, a delay of the change of the air quantity with respect to the change of the air-fuel ratio is also sufficiently decreased, and both torque and engine speed can be controlled as the target. Meanwhile, however, as shown in the chart at the lowermost stage of FIG. 4, the NOx concentration in the exhaust gas which is exhausted from the catalytic device temporarily increases. This is because as a result that the actual air-fuel ratio significantly deviates to the lean side with respect to the original required air-fuel ratio as shown in the chart at the third stage of FIG. 4, the oxygen storage amount of the catalyst is saturated, and the reducing reaction of NOx does not advance.

In contrast with this, in the present embodiment shown in FIG. 3, the step signal of the required air-fuel ratio is directly outputted as the target air-fuel ratio. Accordingly, as shown in the chart at the third stage of FIG. 3, the actual air-fuel ratio does not significantly deviate to the lean side with respect to the original required air-fuel ratio, and increase in the oxygen storage amount of the catalyst can be suppressed. As a result, the oxygen storage amount of the catalyst is prevented from being saturated, and as shown in the chart at the lowermost stage of FIG. 3, increase in the NOx concentration in the exhaust gas which is exhausted from the catalyst is prevented.

Further, as the result that the step signal of the required air-fuel ratio is directly outputted as the target air-fuel ratio in the present embodiment shown in FIG. 3, the target air quantity which is calculated from the target air-fuel ratio also takes on the semblance of a step signal and decreases. Accordingly, the response delay of the actual air quantity to the target air quantity becomes noticeable, and decrease in the air quantity is delayed with respect to the change of the air-fuel ratio to the rich side. However, according to the configuration of the control device 2, the estimated torque which is calculated based on the actual throttle opening becomes larger than the target torque, whereby the ignition timing control efficiency becomes the value smaller than 1, and retardation of the ignition timing with respect to the optimal ignition timing is performed. As a result, the actual torque is restrained from increasing to be larger than the required torque, and both torque and the rotational speed are controlled substantially as the targets.

The embodiment of the present invention is described above, but the present invention is not limited to the aforementioned embodiments, and can be carried out by being variously modified in the range without departing from the gist of the present invention. For example, in the aforementioned embodiment, the throttle is used as the actuator for air quantity control, but an intake valve with a variable lift quantity or working angle can be used.

Further, in the aforementioned embodiment, the change speed of the required air-fuel ratio is lessened by the low-pass filter, but so-called modulating processing may be used. As one example of modulating processing, weighted average can be cited. Alternatively, guard processing is applied to the change rate of the required air-fuel ratio, whereby the change speed also can be lessened.

Further, in the aforementioned embodiment, when the deterioration degree of the catalyst is the reference or more, lessening of the change speed of the required air-fuel ratio is completely stopped, but the lessening degree of the change speed may be decreased. For example, in the case of use of a first order lag filter as the means for lessening the change speed of the required air-fuel ratio, the time constant may be made small. In the case of using weighted average, weight applied onto the value of this time may be made large. In the case of use of guard processing, the guard value of the change rate may be made large. Further, the lessening degree of the change speed of the required air-fuel ratio can be changed in accordance with the deterioration degree of the catalyst. More specifically, the lessening degree of the change speed of the required air-fuel ratio may be made larger as the deterioration degree of the catalyst is smaller, whereas the lessening degree of the change speed of the required air-fuel ratio may be made smaller as the deterioration degree of the catalyst is larger.

Further, in the aforementioned embodiment, torque, an air-fuel ratio and an efficiency are used as the control variables of the engine, but only torque and an air-fuel ratio may be used as the control variables of the engine. More specifically, the efficiency can be always fixed to 1. In such a case, the target torque is directly calculated as the torque for air quantity control.

DESCRIPTION OF REFERENCE NUMERALS

2 Controller
4 Throttle
6 Ignition device
8 Fuel injection device
10 Combustion securing guard section
12 Air quantity control torque calculating section
14 Target air quantity calculating section
16 Throttle opening calculating section
18 Estimated air quantity calculating section
20 Estimated torque calculating section
22 Ignition timing control efficiency calculating section
24 Combustion securing guard section
26 Ignition timing calculating section
28 Target air-fuel ratio generating section
30 Combustion securing guard section
32 Catalyst deterioration determining section

The invention claimed is:

1. A control device for an internal combustion engine, comprising:

requirement acquiring means that acquires a required torque and a required air-fuel ratio of the internal combustion engine;

target air-fuel ratio generating means that generates a target air-fuel ratio by lessening a change speed of the required air-fuel ratio;

target air quantity calculating means that calculates a target air quantity for realizing the required torque under the target air-fuel ratio, based on data in which a relationship of torque generated by the internal combustion engine and an air quantity which is taken into a cylinder is fixed by being related to an air-fuel ratio;

air quantity control means that manipulates an actuator for air quantity control in accordance with the target air quantity;

fuel injection quantity control means that manipulates an actuator for fuel injection quantity control in accordance with the target air-fuel ratio; and determination means that acquires information relating to a deterioration degree of a catalyst which is disposed in an exhaust passage of the internal combustion engine, and determines the deterioration degree of the catalyst based on the acquired information, wherein the target air-fuel ratio generating means stops lessening of the change speed of the required air-fuel ratio, or decreases a lessening degree of the change speed of the required air-fuel ratio, when the deterioration degree of the catalyst is a predetermined reference or more.

2. A control device for an internal combustion engine, comprising:

a unit that acquires a required torque and a required air-fuel ratio of the internal combustion engine;

a unit that generates a target air-fuel ratio by lessening a change speed of the required air-fuel ratio;

a unit that calculates a target air quantity for realizing the required torque under the target air-fuel ratio, based on data in which a relationship of torque generated by the internal combustion engine and an air quantity which is taken into a cylinder is fixed by being related to an air-fuel ratio;

a unit that manipulates an actuator for air quantity control in accordance with the target air quantity;

a unit that manipulates an actuator for fuel injection quantity control in accordance with the target air-fuel ratio; and a unit that acquires information relating to a deterioration degree of a catalyst which is disposed in an exhaust passage of the internal combustion engine, and determines the deterioration degree of the catalyst based on the acquired information, wherein the target air-fuel ratio generating unit stops lessening of the change speed of the required air-fuel ratio, or decreases a lessening degree of the change speed of the required air-fuel ratio, when the deterioration degree of the catalyst is a predetermined reference or more.

* * * * *